US006505749B1

(12) United States Patent
Panetta et al.

(10) Patent No.: US 6,505,749 B1
(45) Date of Patent: Jan. 14, 2003

(54) SUPPORTING POLE

(76) Inventors: Anthony A. Panetta, 7446 Abington Way, Brooksville, FL (US) 34613; Frank S. Panetta, 519 Robinhood Rd., Bricktown, NJ (US) 08724

( * ) Notice: Subject to any disclaimer, the term of this patent is extended or adjusted under 35 U.S.C. 154(b) by 0 days.

(21) Appl. No.: 10/013,273

(22) Filed: Dec. 12, 2001

(51) Int. Cl.[7] ..... A47F 5/00

(52) U.S. Cl. ..... 211/86.01; 211/95; 211/163; 211/196

(58) Field of Search ..... 211/205, 196, 211/106, 95, 163, 90.03, 133.3, 134.4, 90.01, 90.02, 88.01, 86.01; 248/249, 220.41, 220.42, 220.43, 222.51

(56) References Cited

U.S. PATENT DOCUMENTS

| | | | | | |
|---|---|---|---|---|---|
| 561,210 | A | | 6/1896 | Downey | |
| 734,995 | A | | 7/1903 | Sullivan | |
| 733,037 | A | | 8/1903 | HeimN | |
| 1,559,783 | A | | 11/1925 | Rose | |
| 2,312,985 | A | | 3/1943 | Bales | |
| 2,868,386 | A | * | 1/1959 | Seyforth | 211/95 |
| 2,872,145 | A | * | 2/1959 | Goldsholl | |
| 2,903,227 | A | | 9/1959 | Key | |
| 2,980,261 | A | | 4/1961 | Young | |
| 3,003,646 | A | | 10/1961 | Wolf | |
| 3,035,708 | A | | 5/1962 | Freeman | |
| 3,158,264 | A | | 11/1964 | Bittner | |
| 3,281,102 | A | | 10/1966 | Hobson | |
| 3,315,819 | A | | 4/1967 | Kingnberry | |
| 3,452,954 | A | | 7/1969 | Lucietto | |
| 3,484,069 | A | | 12/1969 | Larson | |
| 3,502,294 | A | * | 3/1970 | Kalbon et al. | |
| 3,524,646 | A | | 8/1970 | Marschak | |
| 3,739,919 | A | | 6/1973 | Hochman | |
| 3,866,758 | A | | 2/1975 | Strassel | |
| 4,036,369 | A | * | 7/1977 | Eisenberg | 211/88.01 |
| 4,232,790 | A | | 11/1980 | Serrano | |
| 4,480,755 | A | * | 11/1984 | Cartwright | 211/163 X |
| 4,723,663 | A | | 2/1988 | Learn | |
| 4,809,940 | A | | 3/1989 | Trestyn | |
| 4,809,941 | A | * | 3/1989 | Sheridan | |
| 4,813,535 | A | * | 3/1989 | Radocha et al. | 211/106 X |
| 5,050,746 | A | | 9/1991 | Frankel | |
| D323,080 | S | | 1/1992 | Allen | |
| 5,127,528 | A | | 7/1992 | Cone | |
| 5,284,260 | A | | 2/1994 | Caligiuuri | |
| 5,494,177 | A | * | 2/1996 | Todd | 211/163 |
| 5,505,319 | A | * | 4/1996 | Todd | 211/95 |
| 5,931,315 | A | | 8/1999 | Lorentz | |
| 6,129,222 | A | * | 10/2000 | Mylander et al. | 211/106 |

* cited by examiner

*Primary Examiner*—Robert W. Gibson, Jr.

(57) ABSTRACT

A square hollow and vertically extending pole having floor engaging and ceiling engaging structure on the opposed ends thereof and a plurality of vertically and horizontally spaced openings therein. An attachment having a pair of pegs thereon engaging a pair of vertically spaced openings in the pole and also having a supporting portion for supporting an item placed thereon and an overlying portion for closely overlying an item placed thereon.

9 Claims, 4 Drawing Sheets

SUPPORTING POLE

BACKGROUND OF THE INVENTION

1. Field of the Invention

This invention relates to supporting poles with attachments generally and more particularly to such a pole which can be easily yet securely secured in an upright position in a rotatable manner between the floor and ceiling and wherein its attachments both overly and underly an item supported thereby.

2. Description of the Prior Art

Supporting poles with attachments are well known in the prior art as exemplified by the devices seen in U.S. Pat. Nos. 2,903,227 and 5,050,746. However such prior art devices do not provide for easy yet secure securement for the supporting pole in a rotatable upright position either between the floor and the ceiling or between a wall and the floor and the attachments utilized therewith do not adequately secure an item supported thereon so that the overall arrangement does not adequately support the item on the attachment relative to the floor.

SUMMARY OF THE INVENTION

The present invention includes a pair of releasable securing devices, one for rotatably securing the supporting pole to the floor and a second for rotatably securing the pole to the ceiling or one for securing the pole to a wall and the other for securing the pole to the floor. Pole attachments are secured to and carried by the supporting pole and both overly and underly an item carried thereby so that the item is adequately supported relative to the floor and, therefore, is not easily dislodged from the support to thereby fall on the floor and become damaged.

DETAILED DESCRIPTION OF THE PREFERRED EMBODIMENT

Figure 1:
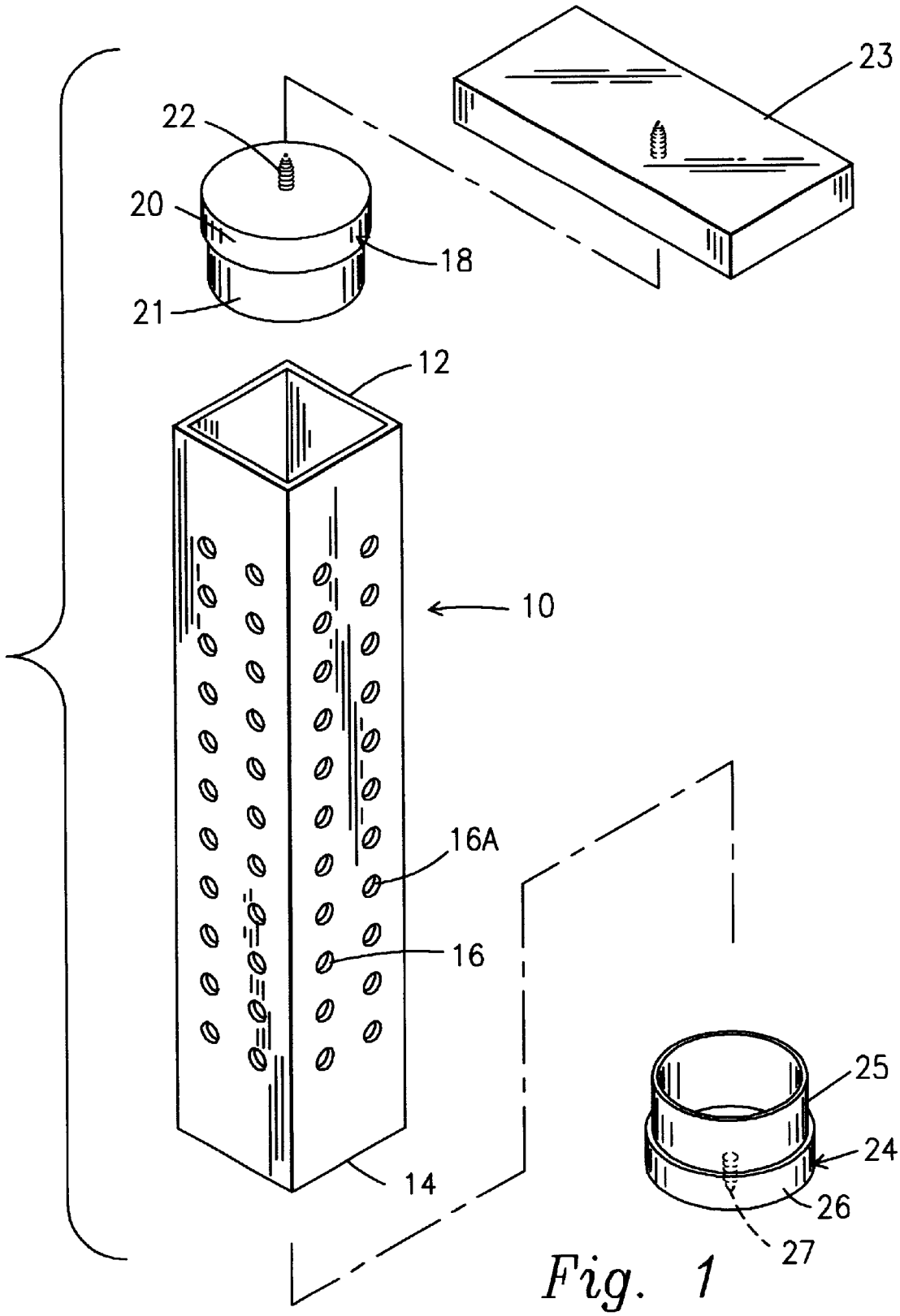
FIG. 1 is an exploded perspective view of a pole made in accordance with this invention.

Referring now to the drawings, a vertically elongated hollow pole is shown at 10 which is rectangular in cross section and has a top 12 and a bottom 14; it being understood that other circumferential configurations of the pole can be utilized by making minor modifications in the elements cooperating therewith. Additionally, a plurality of vertically spaced openings 16 are provided therein in paired relationship with a like plurality of vertically spaced openings 16A, with the openings 16 and 16A being circumferentially displaced from each other and disposed in the faces of the rectangular walls of the tube of the pole 10. An annular top support 18 is provided with a first cylindrical portion 21 depending centrally from an enlarged second cylindrical portion 20. The first cylindrical portion 21 is dimensioned so that it will enter the upper end of the pole 10 in a closely fitting and supporting relationship while allowing relative rotation to take place there between and is vertically elongated to provide for limited telescopic movement which is desirable for the assembly thereof, while the enlarged second cylindrical portion 20 is dimensioned so that it can abut the top 12 of the tube 10 to thereby be a physical stop in the event the tube is attempted to be moved upwardly too far; it being understood that the top support 18 can be modified to receive the periphery of the tube instead of fitting therein. An attaching screw 22 is provided centrally in the top support 18 and projects upwardly therefrom so that it can be directly screwed into the ceiling thereabove if it is aligned with a ceiling joist, or if it is located between joists, it can be screwed into and through a ceiling plate 23 to limit unit pressure on the usual ceiling elements (not shown) such as dry wall; it being understood that as it the usual case with drywall, if the ceiling between joists is drywall, then the screw 22 that would be used would be preferably be a toggle bolt. A support 24 is provided to rotatable support the pole 10 relative to the floor and includes a first annular shoulder 25 which is dimensioned so as to be telescopically and rotatably received in the lower end 14 of the pole 10. A second annular shoulder 26 is formed integrally with the first shoulder 25, and projects downwardly therefrom so as to be in position to engage the floor (not shown) and a screw 27 is dispose in the center of the shoulder 26 in a position to be screwed into the floor (not shown) to securely attach the lower end of the pole. Instead of the screw 27, the support may be secured to the floor in other well know manners, as by an adhesive.

Figure 2:
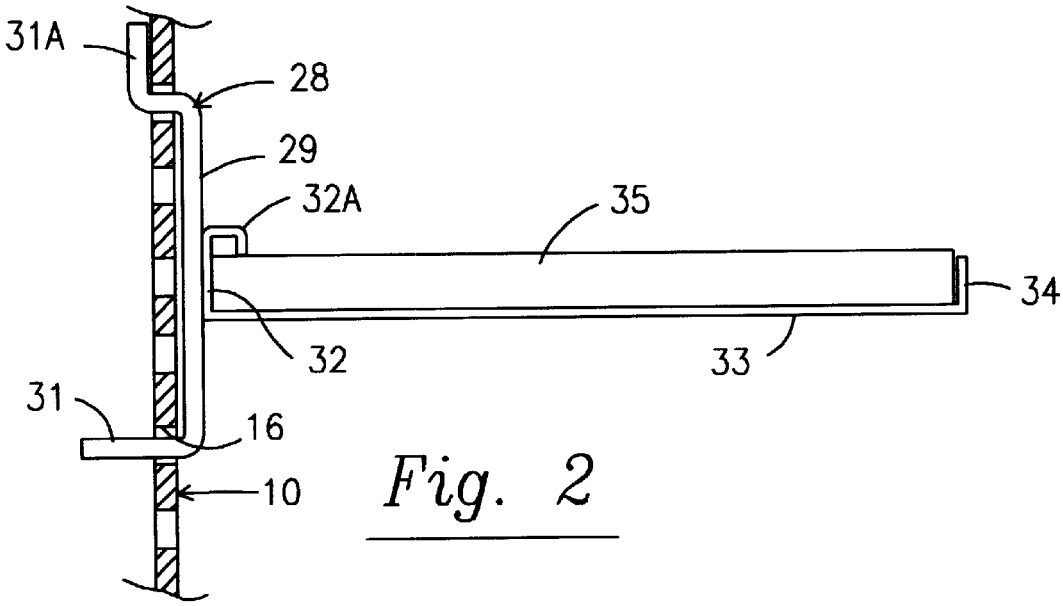
FIG. 2 is a fragmentary elevational view, partially in section, of a pole with an attachment thereon and an item supported by the attachment.
Figure 3:
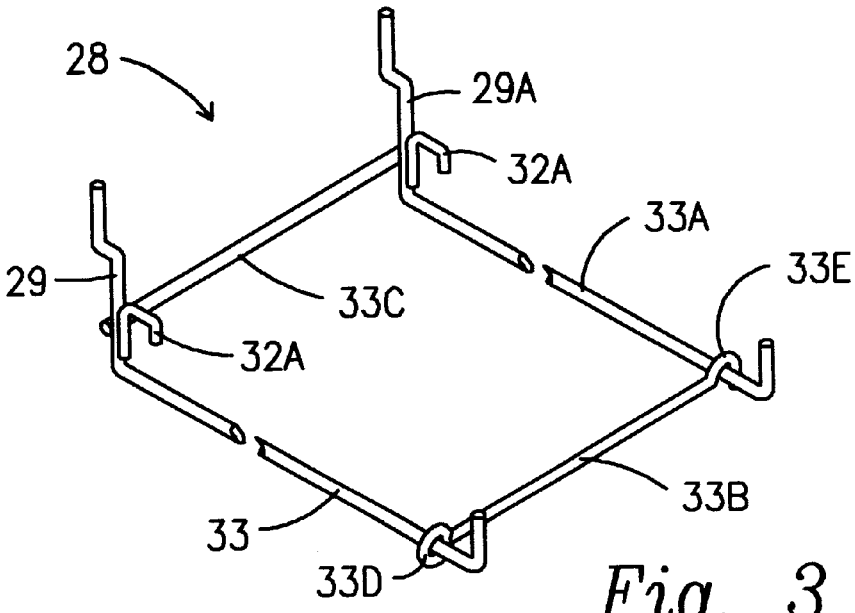
FIG. 3 is a perspective view of the attachment shown in FIG. 2.

Referring now to FIG. 2, an attachment 28 is shown, which includes a vertical element 29 with an integral pair of vertically spaced peg portions, a lower portion 31 and an upper portion 31A, which portions extend horizontally from the element 29 and into a pair of vertically aligned and spaced openings 16 in the pole 10, to thereby support the attachment 28 relative to the pole 10; the inner end of the peg 31A being deflected upwardly in a well known manner to removably, yet securely, hold the bracket 28 on the pole 16. A horizontally extending bracket 33, supporting an item 35, includes a supporting attaching portion 32 formed integrally with the bracket 33, which portion 32 extends first vertically in a welded relationship with the vertical element 29, it alternatively can be formed unitarily therewith, and then horizontally to the right with a portion 32A to spacedly overly a portion of the remainder of the bracket 33 and also to closely overly the item 35 to thereby intimately hold the item 35 on the bracket 33 and thereby securely support the item 35 on the pole 10 relative to the floor (not shown). The portion 32A can also serve as an attaching point for a bungy cord (not shown) which can be stretched over an item to more intimately secure the same on the attachment 28; when serving as an attachment for such a cord, the portion 32A can be formed in other configurations for better bungy cord attachment, such as a closed circle. In FIG. 3, it is seen that the attachment 28 can include a pair of laterally spaced horizontally extending brackets 33 and 33A with a pair of vertical elements 29 and 29A; with each of these elements having a portion 32A thereon, while the latter portions also can serve as attaching points for a bungy cord to secure an item on the attachment 28. A of pair of laterally extending horizontal brackets 33B and 33C, which extend between and connect the elements 33 and 33A, provide a laterally wide supporting platform for an item, not shown, such as a VCR tape or the like. As seen in FIG. 3, the horizontal bracket 33B has its left end formed in a loop 33D around the bracket 33 so that it may rotate thereabout, while its right end is formed as a hook 33E which can be releaseably secured to the bracket 33A. It is also contemplated that the attachment 28 can be encased in a mesh material (not shown) which can supportingly receive small items, such as screw drivers and pliers.

Figure 4:
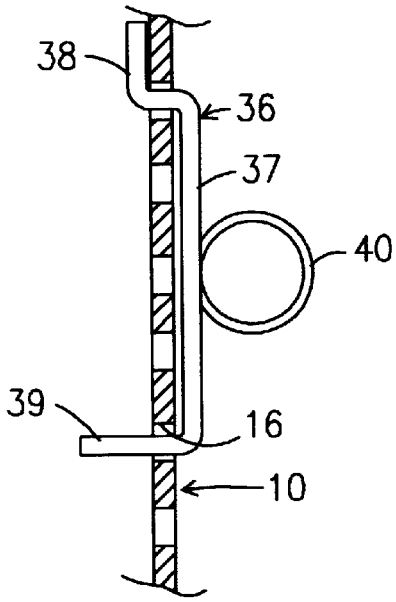
FIG. 4 is a view like FIG. 2 of another embodiment of an attachment.
Figure 5:
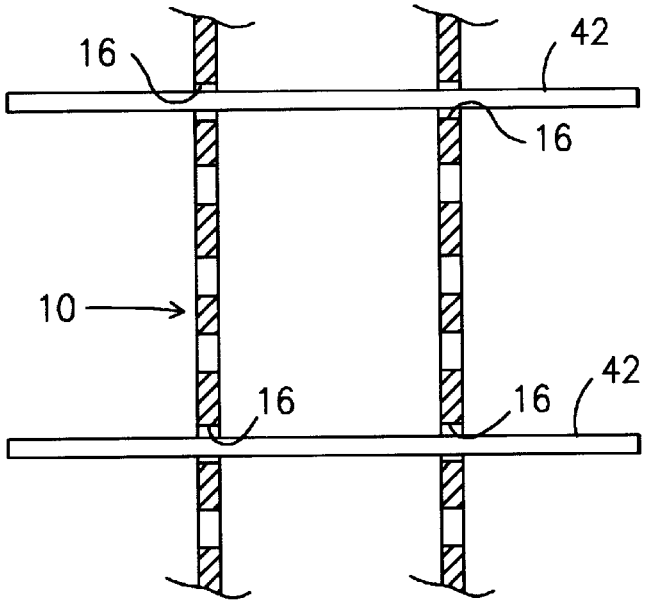
FIG. 5 is a fragmentary elevational view, partially in section, of an item supported directly by a pole made in accordance with this invention.

Referring now to FIG. 4, another attachment 36 is shown including a vertically extending portion 37 with a pair of vertically spaced peg portions 38 and 39 which extend horizontally therefrom and into a pair of vertically aligned and spaced openings 16 in the pole 10 to thereby support the attachment relative to the pole 10, the peg 38 having its inner end bent upwardly in a well known manner to secure the attachment 36 on the pole 10. An annular member 40 is welded to or formed unitarily with the vertical portion 37 and is adapted to intimately support a cylindrical item (not shown) placed therein relative to the pole 10; it being understood that the member 40 and the portion 37 can be of one piece construction. Additionally, the bracket 37 can be a double bracket as is the bracket 28 seen in FIG. 3, in which case there would be a second loop (not shown) like the loop 40, and a long rod shaped member(not shown) could be slid through both loops and be adequately supported thereby, and in turn, if desired, the rod (not shown) could have a variety of items hung thereon or otherwise supported thereby. Referring now to FIG. 5, a pair of rod shaped horizontally extending elements 42 are each inserted thru a pair of horizontally spaced and aligned openings 16 in the pole 10 and are operative to have a number of items (not shown) suspended therefrom.

Figure 7:
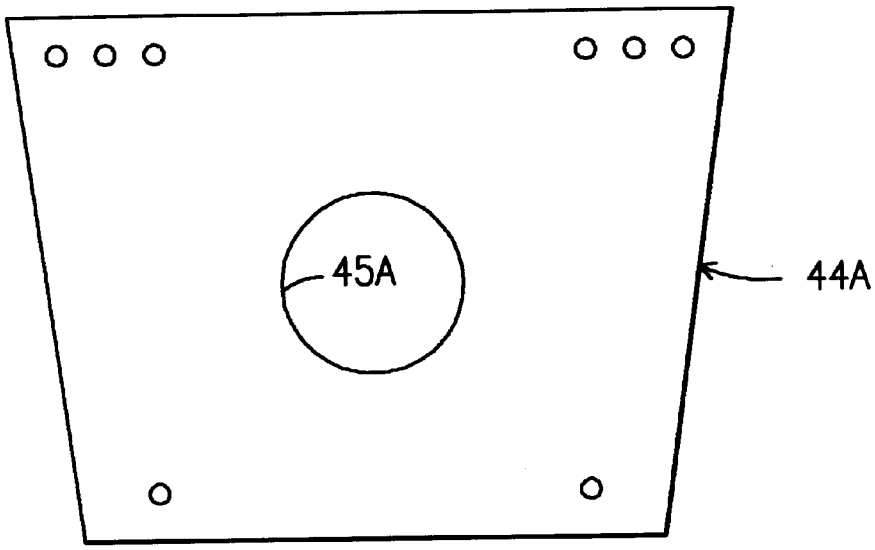
FIG. 7 is a modified top plate to be used with the bracket of FIG. 6.
Figure 6:
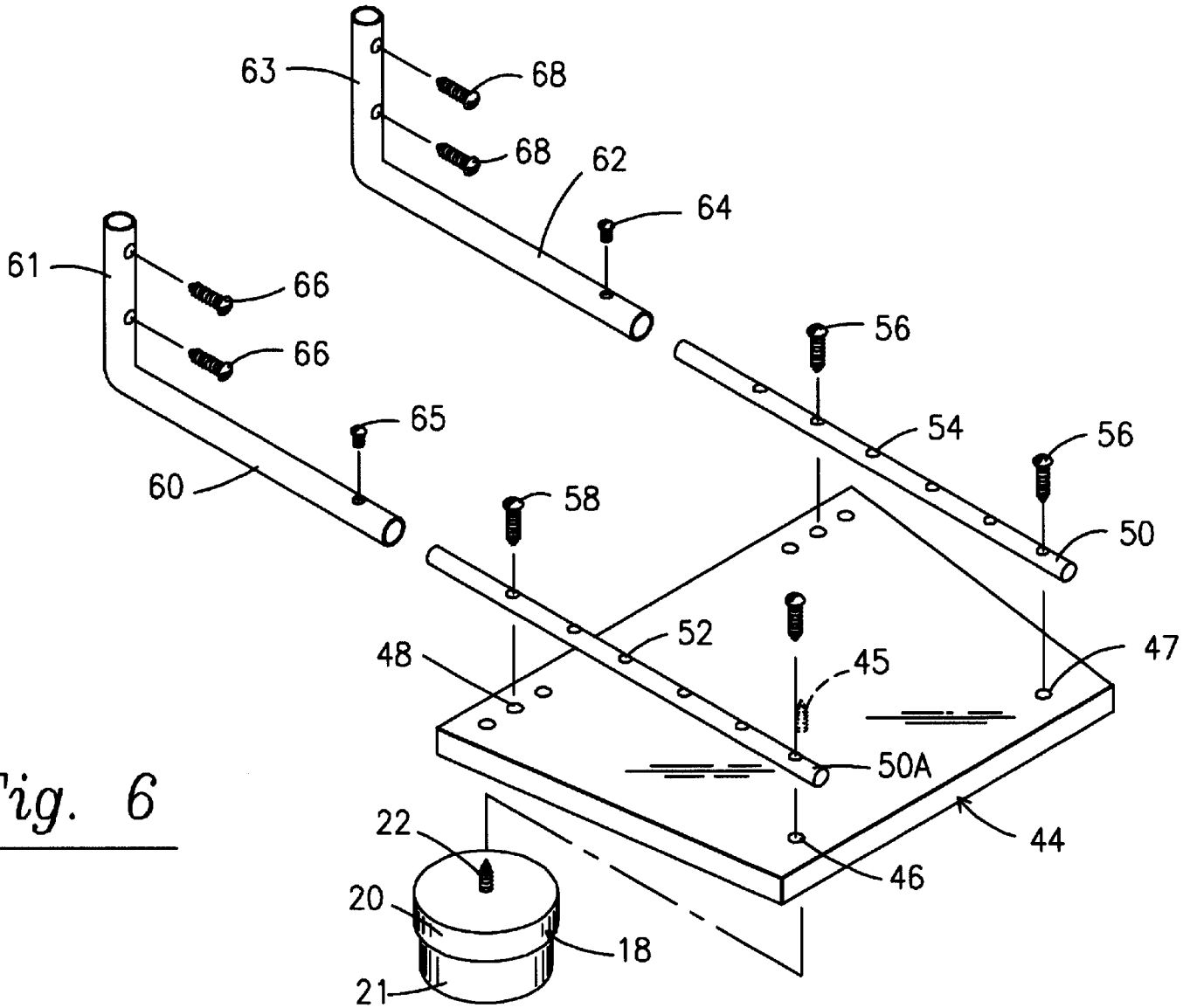
FIG. 6 is an exploded view of a wall mountable bracket usable to support the top of a pole in accordance with this invention.

Referring now to FIG. 6, an attaching bracket is shown generally at 44 and is adapted to be mounted to a wall (not shown) by a pair of hollow tubular "L" shaped brackets 60 and 62. More particularly, the attaching bracket 44 has a pair of spaced openings 46 and 47 formed adjacent its outer end, and a plurality of spaced openings 48 formed adjacent its inner end. A pair of elongated rods 50 and 50A overly the attaching bracket 44, with the rod 50 having a plurality of axially spaced screw receiving openings 54 therein, and the rod 50A having a plurality of axially spaced openings 52 therein. A pair of screws 56 pass through a pair of the openings 54 which are aligned with an opening 47 and one of the openings 48 to thereby attach the rod 50 to the bracket 44, and a pair of screws 58 pass through a pair of openings 52 which are aligned with an opening 46 and one of the openings 48 to thereby attach the rod 50A to the bracket 44. The rods 50 and 50A extend beyond the left extremity of the bracket 44, with the rod 50 being telescopically received for relative axial adjustment in the tubular bracket 62 and the rod 50A being telescopically received for relative axial adjustment in the tubular bracket 60. A screw 64 in the tubular bracket 62 is receivable in a hole 54 in the rod 50 to secure the axial relationship thereof. Likewise, a screw 65 in the tubular bracket 60 is receivable in a hole 52 in the rod 50A to secure the axial relationship thereof. The bracket 60 has a vertically upwardly bent leg 61 while the bracket 62 has a vertically upwardly bent leg 63, and a plurality of screws 66 are received in the leg 61 for securing the latter to a wall (not shown) and a plurality of screws 68 are received in the leg 63 for securing the latter to a wall (not shown). The particular openings of the plurality of openings 48 which are chosen to receive the screws 56 and 58 is dictated by the horizontal space between the studs in the wall, as it is desirable that the screws 66 and 68 are screwed into studs. Thus, the horizontal space between the brackets 60 and 62 can be adjusted. The screw 22 in the top support 18 is receivable in an opening 45 formed medially in the bracket 44 to thereby support the top of a end of a pole, while the bottom end is supported on the floor as previously discussed; however, a bracket 44 could be reversed to support the bottom of the pole, while the top of the pole is supported by the ceiling or by a top bracket 44 as seen in FIG. 6. The telescoping length of the rods 50 and 50A is selected based on the desired space of the bracket 44 from the wall. Referring now to FIG. 7, the bracket 44A is shown with a central opening 45A which can directly receive the top of a pole or can receive the top of a top support 18.

While only a single embodiment of a pole and several embodiments of attachment devices have been shown and described, it is understood that many changes can be made therein without departing from scope of this invention as claimed.

What is claimed is:

1. A rotatable support pole assembly in combination with at least one attachment means for supporting merchandise comprising:

a) a vertically extending hollow pole having a plurality of vertically and horizontally spaced apertures therein, said pole being vertically elongated and having opposed top and bottom ends, b) upper and lower cylindrical pole engaging devices comprising a pair of cylinders engaging the top and bottom ends of said pole, said pair of cylinders being of a diameter to closely engage the periphery of said top and bottom ends of said pole, allowing said pole to rotate, c) a cylindrical end cap fastened to said cylinder, said end cap having a flat closed end with a hole in the center thereof to accept fastening means, and d) at least one attachment means carried by said pole for supporting merchandise thereon.

2. The rotatable support pole assembly of claim 1 wherein, said cylinder is of a diameter to closely fit within the inner periphery of bottom end of said pole.

3. The rotatable support pole assembly of claim 1 wherein, each of said cylinder is of a diameter to closely surround the outer periphery of said bottom end of said pole.

4. The rotatable support pole of claim 1 wherein, each said cylinder is made from a length of pvc pipe.

5. The rotatable support pole assembly of claim 1 in combination with a devise for rotatably securing the top of said pole, said device comprising:

a pair of wall mountable telescoping brackets, said telescoping brackets attachable at their ends to a pair of wall studs, said telescoping brackets connected at their other ends to a horizontal support member, said horizontal support member engaging and supporting said upper cylindrical pole engaging device.

6. A rotatable support pole assembly in combination with at least one attachment means for supporting merchandise comprising:

a) a vertically extending hollow pole having a plurality of vertically and horizontally spaced apertures therein, said pole being vertically elongated and having opposed top and bottom ends, b) upper and lower pole engaging devices, c) said lower pole engaging device comprising a cylinder engaging the bottom end of said pole, said cylinder being of a diameter to engage the periphery of said bottom end of said pole, a cylindrical end cap fastened to said cylinder, said end cap having a flat closed end with a hole in the center thereof of accept fastening means, d) said upper pole engaging device comprising a pair of wall mountable telescoping brackets, said telescoping brackets attachable at their ends to a pair of wall studs, said telescoping brackets connected at their other ends to a horizontal support member, said horizontal support member having a hole there through, said pole top end engaged rotatably within said hole, whereby said upper and lower pole engaging devices allow said pole to rotate, and e) at least one attachment means carried by said pole for supporting merchandise thereon.

7. The rotatable support pole assembly of claim 6 wherein, said cylinders is of a diameter to closely fit within the inner periphery of bottom ends of said pole.

8. The rotatable support pole assembly of claim 6 wherein, said cylinders is of a diameter to closely surround the outer periphery of said bottom ends of said pole.

9. The rotatable support pole assembly of claim 6 wherein, said cylinder is made from a length of pvc pipe.

* * * * *